US011352206B2

(12) United States Patent
Sundholm

(10) Patent No.: US 11,352,206 B2
(45) Date of Patent: Jun. 7, 2022

(54) APPARATUS FOR PROCESSING MATERIAL, AND WASTE CONTAINER/SEPARATING DEVICE

(71) Applicant: MARICAP OY, Vantaa (FI)

(72) Inventor: Göran Sundholm, Tuusula (FI)

(73) Assignee: MARICAP OY, Vantaa (FI)

( * ) Notice: Subject to any disclaimer, the term of this patent is extended or adjusted under 35 U.S.C. 154(b) by 327 days.

(21) Appl. No.: 16/545,980

(22) Filed: Aug. 20, 2019

(65) Prior Publication Data

US 2019/0367271 A1 Dec. 5, 2019

Related U.S. Application Data

(62) Division of application No. 14/423,376, filed as application No. PCT/FI2013/050841 on Sep. 2, 2013, now Pat. No. 10,442,620.

(30) Foreign Application Priority Data

Sep. 4, 2012 (FI) ..... 20125915
Oct. 2, 2012 (FI) ..... 20126023

(51) Int. Cl.
*B30B 9/30* (2006.01)
*B65F 1/14* (2006.01)
(Continued)

(52) U.S. Cl.
CPC ..... *B65F 3/143* (2013.01); *B30B 9/301* (2013.01); *B30B 9/3042* (2013.01);
(Continued)

(58) Field of Classification Search
CPC .... B65F 3/14; B65F 3/143; B65F 3/20; B65F 3/201; B65F 1/14; B65F 1/1405;
(Continued)

(56) References Cited

U.S. PATENT DOCUMENTS 2,622,748 A * 12/1952 Feidert ..... B30B 9/3057 100/244
3,948,167 A 4/1976 De Feudis
(Continued)

FOREIGN PATENT DOCUMENTS

BE 700856 A 12/1967
CN 201456421 U 5/2010
(Continued)

OTHER PUBLICATIONS

English translation of Russian Decision on Grant for Russian Application No. 2015112226, dated Oct. 11, 2017.
(Continued)

*Primary Examiner* — Jimmy T Nguyen
(74) *Attorney, Agent, or Firm* — Birch, Stewart, Kolasch & Birch, LLP

(57) ABSTRACT

An apparatus for processing material in connection with a pneumatic material conveying system includes a waste container/separating device, into which material is configured to be conducted from a conveying pipe of the pneumatic material conveying system via an inlet aperture and which is configured to be connected to a partial vacuum generator. The apparatus further includes a press device/compactor device, which is arranged to act on the material (w) conducted into the waste container/separating device, via at least one aperture formed in the container, and that at least one wall that is transverse with respect to the input direction of the material is arranged in the container space of the waste container/separating device, which wall is configured to guide the material into the operating range in the container space of the compressor of the press device/compactor device.

14 Claims, 10 Drawing Sheets

(51) Int. Cl.

| | |
|---|---|
| ***B65F 3/14*** | (2006.01) |
| ***B65F 5/00*** | (2006.01) |
| ***B65F 1/10*** | (2006.01) |
| ***B65F 3/20*** | (2006.01) |

(52) U.S. Cl.
CPC ..... *B30B 9/3057* (2013.01); *B65F 1/105* (2013.01); *B65F 1/1405* (2013.01); *B65F 3/201* (2013.01); *B65F 5/005* (2013.01)

(58) Field of Classification Search
CPC .. B65F 5/00; B65F 1/105; B65F 5/005; B30B 9/301; B30B 9/3042; B30B 9/3057; B65G 53/60
USPC ..... 100/90, 215, 229 A
See application file for complete search history.

(56) References Cited

U.S. PATENT DOCUMENTS

| | | | | | |
|---|---|---|---|---|---|
| 4,200,422 | A | | 4/1980 | Stodt | |
| 4,374,491 | A | * | 2/1983 | Stortroen | A61L 11/00 100/73 |
| 4,650,546 | A | | 3/1987 | Le Jeune | |
| 4,677,909 | A | * | 7/1987 | Beesley | B30B 9/3042 414/400 |
| 5,029,522 | A | | 7/1991 | Brisson | |
| 5,044,870 | A | * | 9/1991 | Foster | B65G 25/065 414/809 |
| 5,193,455 | A | | 3/1993 | Lackner | |
| 5,214,594 | A | | 5/1993 | Tyler et al. | |
| 5,575,201 | A | * | 11/1996 | Fenner | B30B 9/3057 100/145 |
| 10,435,239 | B2 | * | 10/2019 | Sundholm | B65F 1/105 |
| 10,442,620 | B2 | * | 10/2019 | Sundholm | B30B 9/301 |
| 2012/0152133 | A1 | | 6/2012 | Newsome, III | |

FOREIGN PATENT DOCUMENTS

| | | | | | |
|---|---|---|---|---|---|
| CN | 101903265 | A | | 12/2010 | |
| DE | 2701336 | B1 | | 5/1978 | |
| DE | 8319572 | U1 | | 11/1983 | |
| DE | 9003804.5 | U1 | | 8/1990 | |
| DK | 2000 00764 | L | | 11/2001 | |
| EP | 0078626 | A2 | * | 5/1983 | B30B 9/3042 |
| EP | 0340377 | A1 | | 11/1989 | |
| EP | 0 903 306 | A1 | | 3/1999 | |
| EP | 1256440 | A1 | | 11/2002 | |
| FR | 2 696 364 | A1 | | 4/1994 | |
| GB | 833126 | A | | 4/1960 | |
| GB | 1257899 | A | | 12/1971 | |
| GB | 2 083 777 | A | | 3/1982 | |
| GB | 2 110 591 | A | | 6/1983 | |
| GB | 2 241 524 | A | | 9/1991 | |
| GB | 2241524 | A | * | 9/1991 | B30B 9/301 |
| GB | 2321024 | A | | 7/1998 | |
| JP | 51-2593 | A | | 1/1976 | |
| JP | 52-134268 | A | | 11/1977 | |
| JP | 7-228304 | A | | 8/1995 | |
| JP | 08-020406 | A | | 1/1996 | |
| NL | 107093 | C | | 1/1964 | |
| SU | 272207 | A1 | | 5/1970 | |
| WO | WO 2005/084509 | A1 | | 9/2005 | |
| WO | WO 2008/016290 | A1 | | 2/2008 | |
| WO | WO 2909/080881 | A1 | | 7/2009 | |
| WO | WO 2013/038057 | A1 | | 3/2013 | |

OTHER PUBLICATIONS

International Preliminary Report on Patentability Wriitten Opinion dated Mar. 10, 2015 for PCT/FI2013/050841.
European Search Report for European Application No. 17160793, completed Jul. 18, 2017.

* cited by examiner

APPARATUS FOR PROCESSING MATERIAL, AND WASTE CONTAINER/SEPARATING DEVICE

CROSS-REFERENCE TO RELATED APPLICATIONS

This application is a Divisional of U.S. patent application Ser. No. 14/423,376, filed on Feb. 23, 2015, which was filed as the National Phase of PCT International Application No. PCT/F12013/050841 on Sep. 2, 2013, which claims the benefit of priority to Finnish Application Nos. 20125915 and 20126023, filed Sep. 4, 2012 and Oct. 2, 2012, respectively, the entire contents of which are hereby expressly incorporated by reference into the present application.

BACKGROUND OF THE INVENTION

The object of the invention is also a press/compactor device, which can be connected to the waste container/separating device according to the invention.

The invention relates generally to material conveying systems, such as to partial-vacuum transporting systems, more particularly to the collection and conveying of wastes, such as to the conveying of household wastes.

Systems wherein wastes are conveyed in piping by means of a pressure difference or suction are known in the art. In these, wastes are conveyed long distances in the piping by sucking. It is typical to these systems that a partial-vacuum apparatus is used to achieve a pressure difference, in which apparatus negative pressure is achieved in the conveying pipe with partial-vacuum generators, such as with vacuum pumps or with an ejector apparatus. A conveying pipe typically comprises at least one valve means, by opening and closing which the replacement air coming into the conveying pipe is regulated. Inlet points, such as refuse chutes, are used in the systems at the material input end, into which inlet points material, such as waste material, is fed and from which the material to be conveyed is conveyed into a conveying pipe by opening a discharge valve means. The conveying of wastes occurs mainly by the aid of a pressure difference produced by an air flow. The air flow is generally brought about by sucking air through the piping. Waste material, such as e.g. waste material packed into bags, is conveyed from an inlet point into a conveying pipe and onwards into a separating device, where the wastes are separated from the transporting air. In connection with the separating device can be a transfer device, such as a transfer device arranged into a cylinder-piston combination, with which transfer device the wastes are displaced from the separating device into a waste container, e.g. into a mobile freight container. These types of solutions comprising a separate separating device, e.g. a cyclone separator, and a waste container separate to it, are well suited to extensive systems in which the space requirements of the waste station do not set limitations. Also known in the art are solutions wherein waste material is conducted in a conveying pipe directly into a waste container, which simultaneously functions as a separating device. These are mainly intended for rather small systems. This type of waste container/separating device is often arranged to be a kind of mobile freight container. In the art they are called horizontal separator containers. A problem in prior-art combinations of a waste container and separating device, more particularly in horizontal separator containers, is that in them a part of the material, or certain types of materials, remain in the container space loosely packed and thus take up space.

The aim of the present invention is to achieve an entirely new type of solution in connection with a waste container/separating device of a pneumatic wastes conveying system. One aim of the invention is to achieve a waste container/separating device, by the aid of which the problems of prior art that are described above are avoided. Another aim is to achieve a combination of a waste container/separating device and a press device/compactor device, by the aid of which material can be efficiently condensed into the container space of the waste container/separating device.

BRIEF DESCRIPTION OF THE INVENTION

The press device/compactor device according to the invention is mainly characterized by what is stated in the characterization part of claim 1.

The solution according to the invention has a number of important advantages. One advantage, among others, achieved with the solution according to the invention is that a separate separating device is not needed, but instead the waste container functions as an effective separator device and at the same time material can be efficiently compacted in it. In the solution of the invention, therefore, material can be compacted directly in the waste container, which is preferably formed to be a container of the mobile freight container type. By arranging a wall in the container space in the waste container/separating device, which wall guides the material being fed in into the operating range of a press, an effective solution is achieved for compressing material and compacting it, i.e. condensing it, in the container space. The wall also prevents the return or displacement of compressed material in the container space backwards past the press. The wall is thus configured to prevent the passage of compressed material in the opposite direction to the compression direction, in which case material can be condensed into the container space efficiently with the press. By using a movable part that has a support surface, the wall can be supported when the press is operated. In this case material can be efficiently compacted into the container part better than before. The movable part can be a part of the press device, e.g. a moving frame of the press. The press device can have different embodiments, in which case the effective compression distance and other properties of it can be configured according to the application site. The movable part can have an aperture on the side from which material is conducted via the inlet aperture into the container, in which case it can be used for the effective conducting of material into the operating range of the compressor. The waste container/separating device can be emptied easily, because the wall in the container space is arranged to be turnable away from the front, e.g. by hinging, in which case it does not hinder the emptying.

By arranging the press device/compactor device to comprise its own inlet aperture for material, the material can be fed past directly into the waste container/separating device for compressing and compacting with the press device/compactor device. In this case e.g. material that is too large in size or otherwise unsuitable for the conveying piping of the pneumatic material conveying system can nevertheless be fed in and conveyed via the inlet aperture of the press device/compactor device into the waste container/separating device. By arranging the compressor of the press device/compactor device and the drive device of said compressor in a moving frame, which is moved by its own drive device, a versatile solution is achieved for driving the press device/compactor device and its compressor.

BRIEF DESCRIPTION OF THE FIGURES

In the following, the invention will be described in more detail by the aid of an embodiment with reference to the attached drawings, wherein.

DETAILED DESCRIPTION OF THE INVENTION

Figure 1:
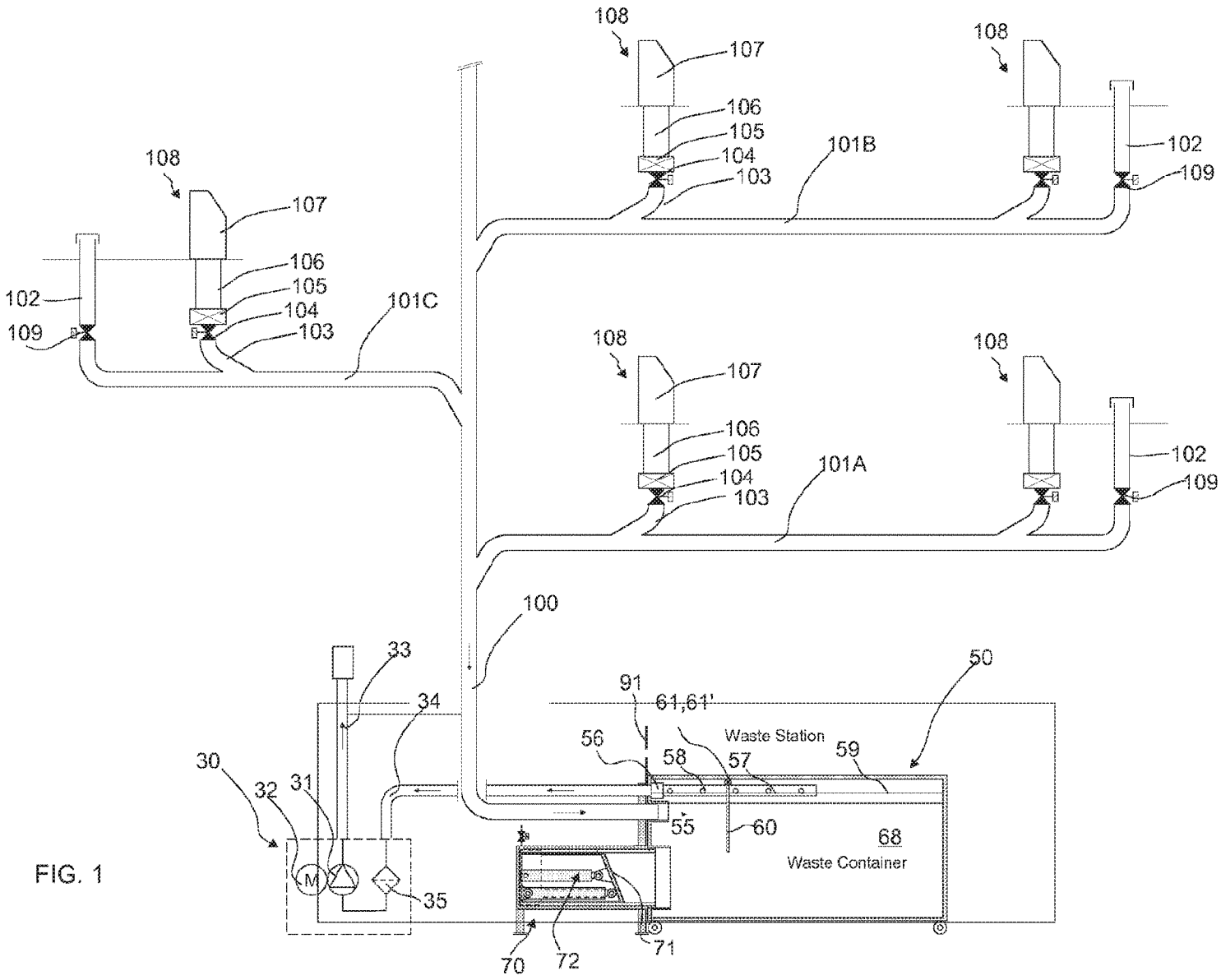
FIG. 1 presents a simplified and partially cross-sectioned view of an embodiment of the invention in connection with a pneumatic conveying system for wastes.

FIG. 1 presents a diagram of part of a pneumatic material conveying system, which part comprises a material conveying pipe 100, along the side of which at least one, typically many, inlet points 108 are arranged. An inlet point 108 is an inlet point of material, more particularly of waste material, intended to be transported, from which inlet point the material, more particularly waste material, such as household waste, or recyclable material, intended to be transported is fed into the conveying system. An inlet point 108 can also be a refuse chute, into which material is fed from inlet apertures on different floors of a building. The system can comprise a number of feed-in stations 108, from which the material intended to be transported is fed into conveying piping 100, 101A, 101B, 101C. By opening and closing a shut-off means, such as a valve means 104, that is possibly in connection with an inlet point, material can be conveyed from the inlet point 108 into the conveying pipe 100. The inlet point 108 is connected on the valve side to the conveying pipe 100 or to an inlet pipe 103 in connection with it. Typically conveying piping comprises a main conveying pipe 100, to which it has been possible to connect a number of branch conveying pipes 101A, 101B, and in turn to which branch conveying pipes it has been possible to connect a number of feed-in stations 108. In the embodiment of FIG. 1 the inlet point 108 is an inlet point 107 of waste material, said inlet point 107 being disposed on the surface of the ground. The inlet point 108 is connected via a feeder channel 106 to a material shaper 105, which shapes and condenses the material to fit into conveying piping 103, 101A, 101B, 101C, 100 smaller in diameter than the feeder channel. The solution according to the invention is also suited to those types of material conveying systems in which material shapers are not used, but instead the material is conveyed from inlet points directly into the conveying piping. The conveying piping can be arranged to travel underground. In the embodiment of FIG. 1, the conveying piping comprises replacement air ducts 102, in which a replacement air valve 109 is arranged.

Figure 2:
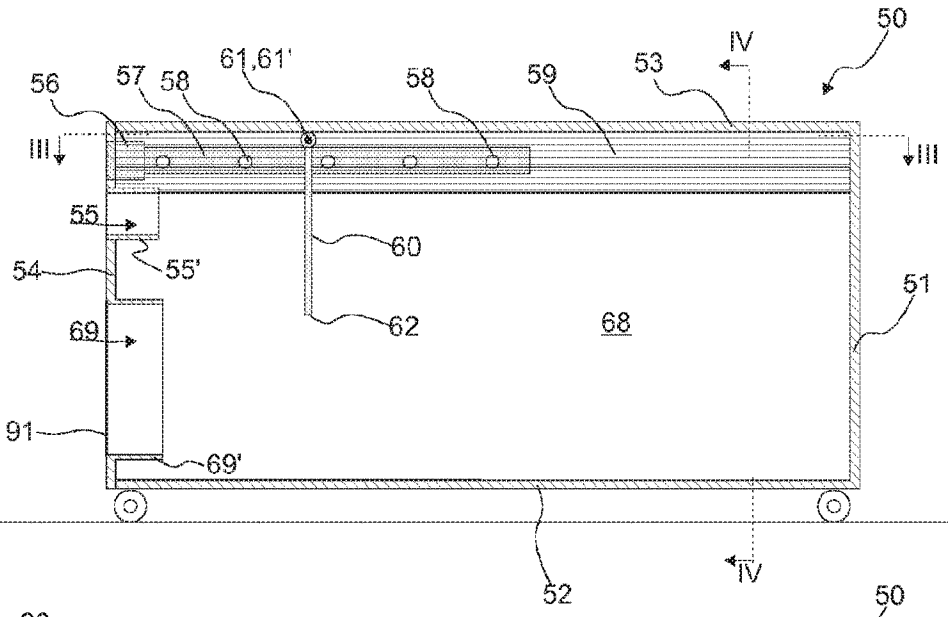
FIG. 2 presents an embodiment of the waste container/separating device according to the invention, cross-sectioned along the line II-II of FIG. 4.

The apparatus comprises a waste container/separating device 50, which is a combination of a collection container for material, which is formed from a container, and means arranged in it separating the transporting air and the material being conveyed from each other. According to one embodiment the waste container/separating device 50 is a movable container/separating device, for example a so-called horizontal separator container. The conveying pipe 100 can be connected to the waste container/separating device 50, in which the material being transported is separated from the transporting air. An inlet aperture 55, into which the conveying pipe 100 can be fitted, is formed in the wall of the waste container/separating device 50, which wall is an end wall 54 in the figure and which in the embodiment of the figure is also an openable and closable door. In FIG. 2 the end of the conveying pipe 100 is fitted into the inlet aperture 55, inside the wall 55' of it. A joint means can also be formed in the conveying pipe 100 and a counterpart in the wall of the container, in the inlet aperture 55, such as a collar formed from the wall 55'. The joint means and the counterpart can in this case together form joint means, e.g. a snap-on coupling. A connection 56 is formed in the waste container/separating device 50, to which connection a pipe or hose 34 coming from the partial-vacuum generator 31 of a partial-vacuum source can be connected with a counterpart.

In the embodiment of FIG. 1 the partial-vacuum source 30 of a pneumatic waste conveying system comprises a partial-vacuum generator 31, which is driven with a drive device 32. The partial-vacuum generator 31 can be e.g. a vacuum pump or some other means achieving negative pressure. The suction side of the partial-vacuum generator 31 is connected to a waste container/separating device 50 via a medium pathway 34. In this case the suction/pressure difference needed in the conveyance of material can be achieved in the waste container/separating device 50, in its container part 68, and via the inlet aperture 55 in the conveying piping 100, 101A, 101B, 101C. Between the partial-vacuum generator 31 and the waste container/separating device 50 is a filtering device 35. On the blowing side of the partial-vacuum generator 31 is an exhaust duct 33. The partial-vacuum source 30, the partial-vacuum generator 31 of it, can be connected from the suction side via the medium pathway 34 to the waste container/separating device 50 with a counterpart arranged in the connection 56.

Figure 4:
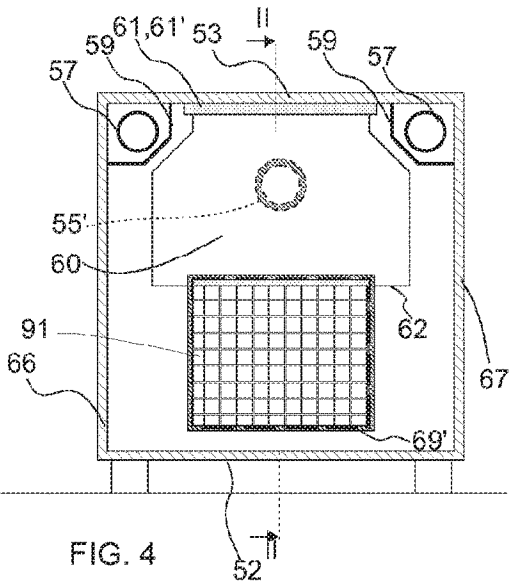
FIG. 4 presents an embodiment of the waste container/separating device according to the invention, cross-sectioned along the line IV-IV of FIG. 2.
Figure 3:
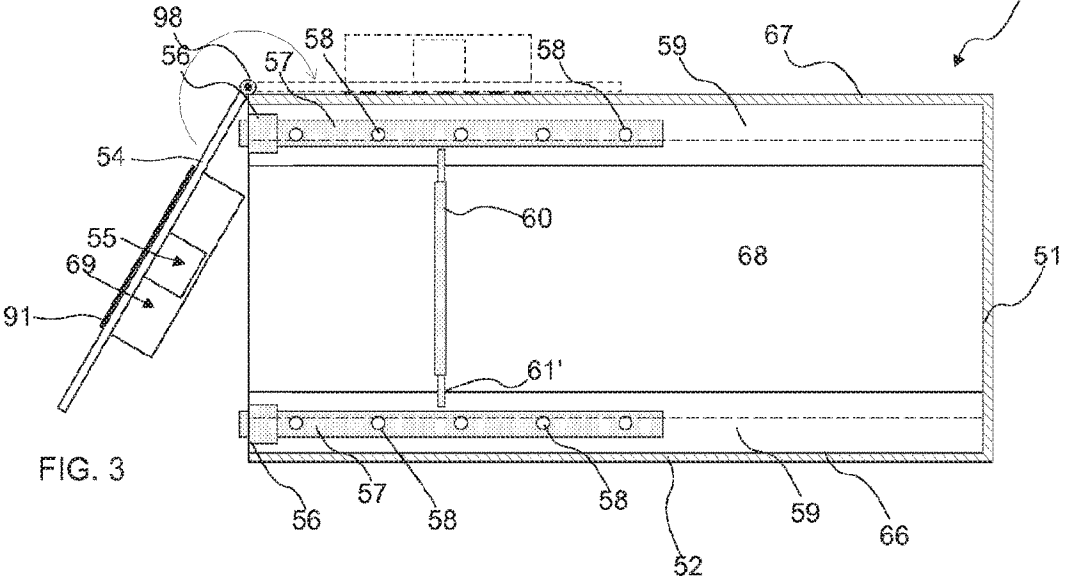
FIG. 3 presents an embodiment of the waste container/separating device according to the invention, cross-sectioned along the line III-III of FIG. 2.

One waste container/separating device 50 according to an embodiment of the invention is presented in more detail in FIGS. 2-4. In the solution according to FIGS. 2-4 the waste container/separating device 50 comprises a base 52, an end wall 51, a top wall 53, side walls 66, 67 and a second end wall, which in the embodiment of the figure is an openable and closable door 54. The walls 51, 52, 53, 54, 66, 67 bound the container space 68. A wall 60 is arranged in the container space 68, which wall extends from the top part of the container a distance towards the bottom part of the container when the wall 60 is in a vertical position. In the embodiment of FIGS. 2-4 the wall 60 is arranged to be hinged at its top part 61 around the axis 61' to the top wall 53 of the container. The wall 60 is therefore turnable in relation to the transverse axis 61'. The wall 60 is arranged to a part of the height of the container space 68, in which case a free space is between the bottom part 62 of the wall 60 and the base 52 of the container. The wall 60 is arranged at the point of the inlet aperture 55 in the height direction of the container, and at a distance from it in the longitudinal direction of the container. A gap remains between the side edges of the wall 60 and the side walls 66, 67 of the waste container/separating device. According to one preferred embodiment the wall is a flap that is hinged at its top edge. The wall 60 is planar in the figure, but it can also be another shape, e.g. concave, convex or wavy. The wall can be e.g. of metal such as steel, or of a plastic material, rubber material or combinations of them. Other suitable materials can be considered, depending on the application site.

In the embodiment of FIGS. 2-4 the waste container/separating device 50 comprises at least one suction pipe 57, which extends from the connection 56 into the inside space of the waste container/separating device. In the embodiment of FIGS. 2-4 the suction pipe 57 is arranged in the top part of the container space 68 of the waste container/separating device in the orthogonal cross-section (FIG. 4) of the container, with respect to the longitudinal direction of the container, in the corner area, or in the proximity of same, between the top wall 53 and the side wall 66 and/or 67. In the embodiment of FIGS. 2-4 the waste container comprises two suction pipes 57. Of these, the first is arranged in the orthogonal cross-section (FIG. 4) of the container, with respect to the longitudinal direction of the container, in the corner area, or in the proximity of same, between the top wall 53 and the side wall 66 and the second suction pipe is arranged in the corner area, or in the proximity of same, between the top wall and the second side wall 67. A connection to the suction side of the partial-vacuum generator, i.e. suction, can be arranged via either one of the suction pipes or via both suction pipes.

At least one suction aperture 58 is arranged in the suction pipe 57 for the length of it. In the embodiment of FIGS. 2-4 there are a number of suction apertures 58 for the length of the suction pipe 57 and possibly also arranged on the rim of the wall of the suction pipe 57. A wall part 59, such as dense netting, that allows air to pass through is also arranged in the container space 68, which wall part allows air through but prevents the passage of at least large-sized material particles into the suction pipe 57 from the suction apertures 58. The wall part 59 that allows air to pass through and the top wall 66 of the container and one of the two side walls 66 or 67 form the longitudinal chamber space of the container, into which chamber space the suction pipe 57 is arranged. When the suction side of the partial-vacuum generator 31 is connected to act via the medium channel 34 and the connection 56 in the suction pipe 57, the suction acts via the suction apertures 58, and through the wall 59 that allows air to pass, into the container space 68 of the waste container/separating device and onwards via the inlet aperture 55 into the conveying piping 100, 101A, 101B, 101C.

An aperture 69 is arranged in the waste container/separating device 50 for bringing at least the press part 71 of the press device 70 into the container space 68. In FIGS. 2-4, the aperture 69 has a collar 69', which extends into the container space. In the embodiment of FIGS. 2-4 the aperture 69 for the press device is arranged in the same wall 54 as that in which the inlet aperture 55 is arranged, and below the inlet aperture 55 in the height direction. The compressor is a device for pushing the material to compress the material. The compressor may be a compactor device 70 with a movable press device 71 that can compress material within the container space 68.

According to one embodiment a hatch 91 is arranged to cover the aperture 69, which hatch is displaced from in front of the aperture 69 when the press device 70 is connected in connection with the waste container/separating device 50. In the embodiment of the figure, the door 54 of the wall is hinged to turn around a vertical axis 98, which is illustrated in FIG. 3. The door 54 can be turned in the open position against the outer side of the side wall 67 of the waste container/separating device, as is illustrated in FIG. 3 with dashed lines. This is a preferred position for the door when the container is emptied.

Figure 5:
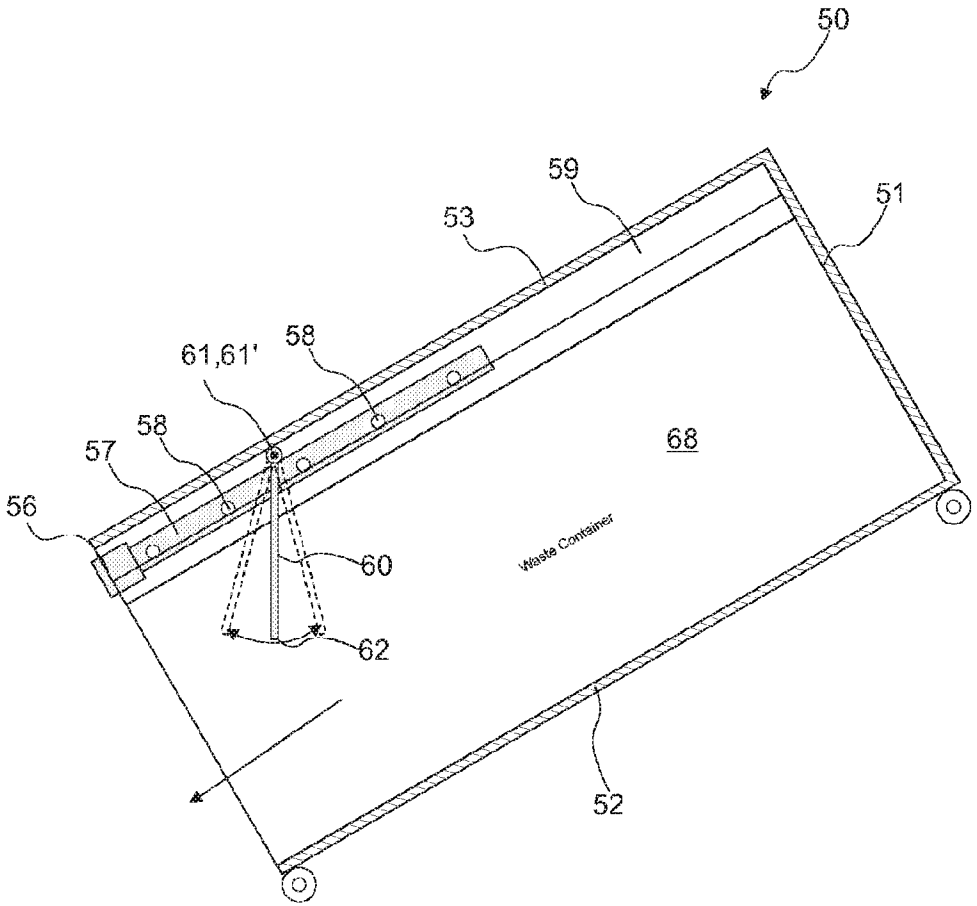
FIG. 5 presents an embodiment of the waste container/separating device according to the invention, in the emptying position

FIG. 5 presents a situation in which the waste container/separating device 50 is in the typical emptying position. It can be seen from the figure that the wall 60 in the container space 68 turns, preferably around the axis 61' owing to the hinging of its top edge 61, when emptying the container of material from the front, in which case emptying can be performed quickly and efficiently. Friction-reducing means, e.g. roller means according to the figure, which facilitate the moving of the waste container/separating device can be arranged on the bottom part of the waste container/separating device 50.

Figure 7:
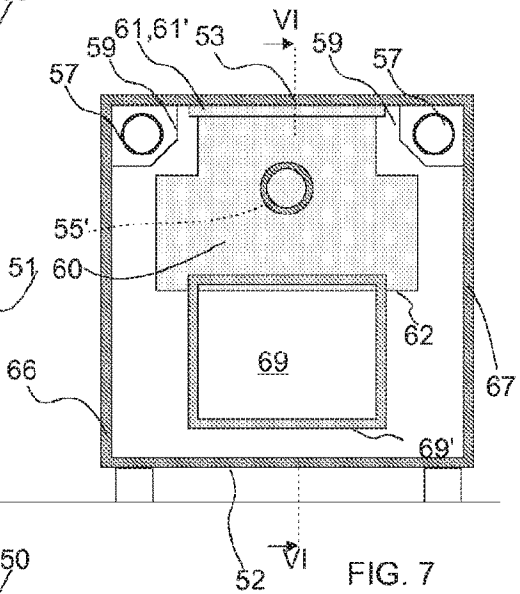
FIG. 7 presents an embodiment of the apparatus according to the invention, cross-sectioned along the line VII-VII of FIG. 6.
Figure 6:
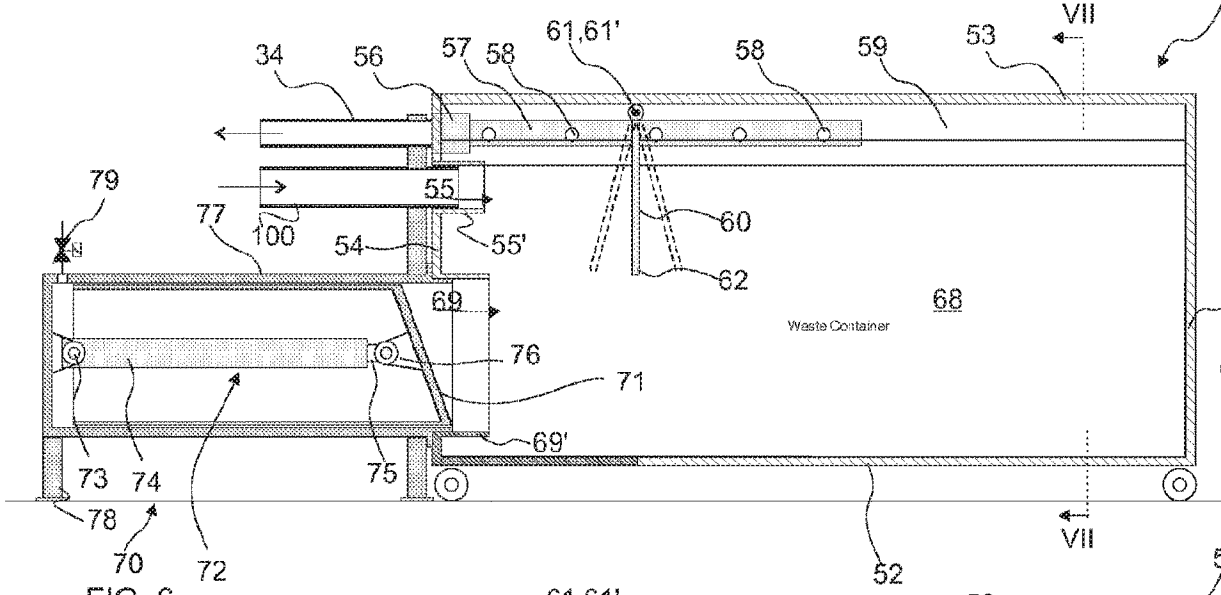
FIG. 6 presents an embodiment of the apparatus according to the invention, cross-sectioned along the line VI-VI of FIG. 7, in a first position.
Figure 8:
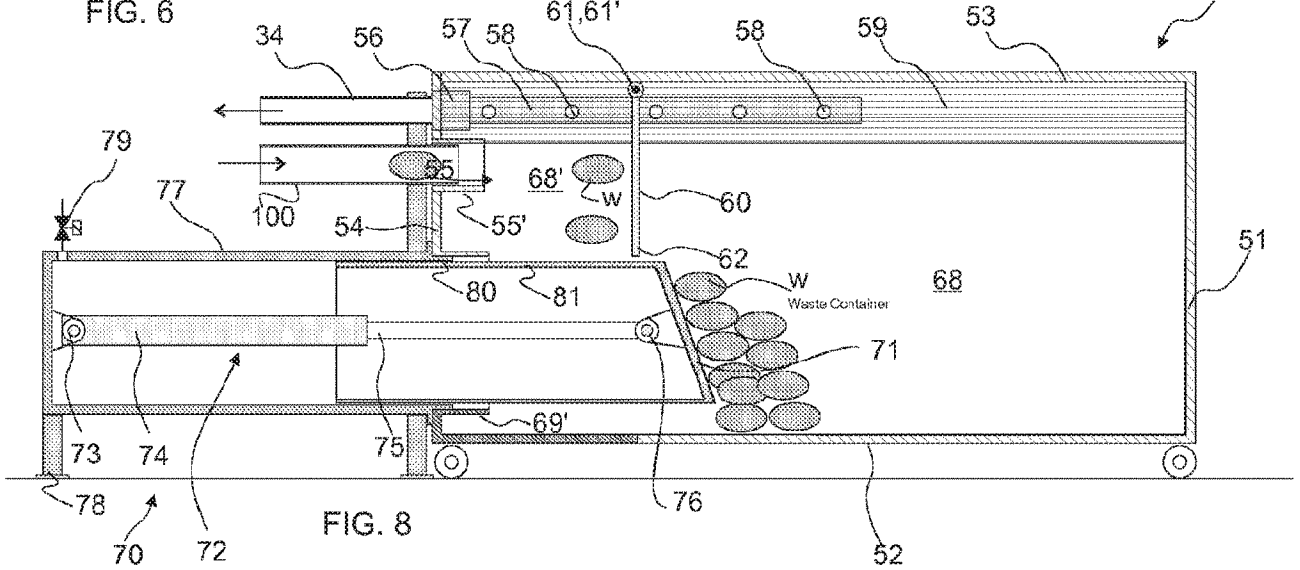
FIG. 8 presents a cross-section of an embodiment of the apparatus according to the invention, in a second position.

FIGS. 6-8 present an embodiment of the device according to the invention, wherein a press device/compactor device 70, comprising a compressor 71 and its drive device 72, is arranged in connection with the waste container/separating device 50. The compressor 71 in the press device/compactor device 70 in the embodiment of the figure is arranged to be movable between at least two positions. The compressor 71 is arranged to displace waste material, which is conducted from the inlet aperture 55 into the waste container/separating device 50, towards the actual container part 68. The compressor conveys and simultaneously also compresses the material w to be denser, i.e. it compacts the waste into the container space 68. In the embodiment of FIGS. 6-8 the press device/compactor device 70 comprises a frame 77, in which the compressor 71 and its moving apparatus are arranged in a first position, i.e. the standby position. The frame 77 comprises a joint part 80, which is configured in such a way that the counterpart, typically a collar 69', of the aperture 69 of the waste container/separating device 50 forms a joint with the joint part 80. In the embodiment of the figure the collar 69' is arranged around the joint part 80 of the frame 77 of the press device/compactor device 70.

Material w, such as household waste is fed in from an inlet point 108 into the piping 101A, 101B, 101C, 100, where it is conveyed by the aid of suction/a pressure difference and/or transporting air flowing in the piping into the waste container/separating device 50 from the inlet aperture 55. The passage of the waste material in the waste container/separating device is limited by the wall 60, into which typically a part of the material being conducted from the inlet aperture 55 collides and drops from the effect of gravity downwards in the container. At least one wall 60 that is transverse with respect to the input direction of the material is arranged in the container space 68 of the waste container/separating device, which wall is configured to guide the material into the operating range in the container space 68 of the compressor 71 of the press device/compactor device.

The material is separated from the transporting air, e.g. by the aid of collision and gravity, in such a way that heavier material W travels to the bottom part of the container. A suction pipe 57 is arranged in the top part of the waste container/separating device 50, which pipe is connected to the suction side of the partial-vacuum generator 31. The transporting air leaves the container part 68 of the waste container/separating device into the suction pipe 57. The wall 59 allowing air to pass through prevents the passage of at least the larger material particles into the suction pipe. The smaller particles are filtered in the filtering device 35 (FIG. 1).

A press device/compactor device 70 is arranged in connection with the waste container/separating device 50, which press device/compactor device is connected to the bottom part of the container part 68 of the waste container/separating device with a connection part 80, which is a collar part. In the embodiment of FIGS. 6 and 7 the compressor 71 is in the first position, i.e. the standby position, in FIG. 6 and extended, i.e. in the compression position, in FIG. 7. In the second position, which is presented in FIG. 8, the compressor 71 extends into the container space 68 of the waste container/separating device 50. In the second position the movement of the compressor 71 extends to at least the point of the wall 60 in the container space 68. The press device/compactor device comprises a horizontal wall part 81 on the side of the inlet aperture 55 of the waste container/separating device 50. In the embodiment of the figure a drive apparatus 72, such as a pressure-medium-driven cylinder-piston combination 74, 75, moves the compressor. The drive apparatus 72 is supported at its first end 73 (in the figure, on the cylinder 74 side) on the structures of the frame 77. At its other end 76, in the figure, on the piston rod 75 side, the drive apparatus is arranged on the compressor 71. The frame is arranged in the embodiment of the figure on a machine bed resting on support legs 78. A pathway for medium is arranged in the frame 77 from the space, in which the compressor is moved, to the outside and to a valve means 79 there, which is a so-called discharge valve. As explained above, the drive apparatus 72 is used to describe the structure of the drive apparatus 72 that may be a pressure-medium-driven cylinder piston combination 74, 75 for moving the compressor 71.

When the material collects from the inlet aperture 55 of the waste container/separating device 50 along with the transporting air, at least a part of the material w collides with the wall 60 and drops downwards in the container space 68. The wall guides the material into the operating range of the compressor 71. With the compressor the material is displaced farther in the container space 68 from the bottom of the wall 60. The compressor 71 is moved reciprocally with a drive apparatus 72 between the first position of FIG. 6 and the second position of FIG. 8. It is also possible that the compressor 71 is moved only a part of the distance between the aforementioned extreme positions. When sufficient material has collected in the container space 68, the compressor 71 compresses it, e.g. against the end wall 51, to be denser. The wall 60 arranged in the container space for its part prevents the compressed material w from returning in the container space 68 in an undesired manner to the inlet aperture 55 side with respect to the wall 60 in the container space 68. This part of the container space 68 is marked in the figure with the marking 68'. It can be called the separating part of the container. This space is bounded above by the top wall 53 of the container and the wall 59 that allows air through, the end wall 54 (i.e. a door) and the wall 60 arranged in the space, and below by at least one wall of the press device/compactor device 70 when it is pushed into the container space at least partly. In the embodiment of FIG. 8 the wall bounding the space 68' of the press device is the top wall 81 of the compressor.

Figure 9:
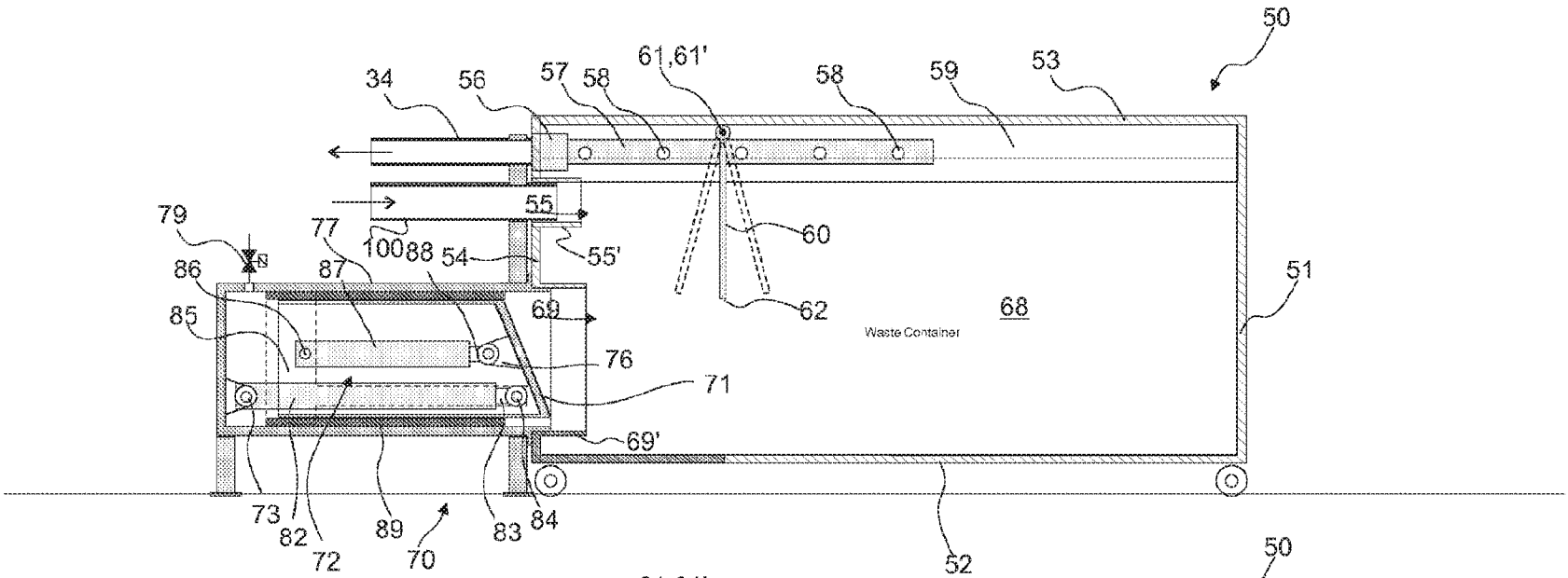
FIG. 9 presents a cross-section of a second embodiment of the apparatus according to the invention, in a first position.
Figure 10:
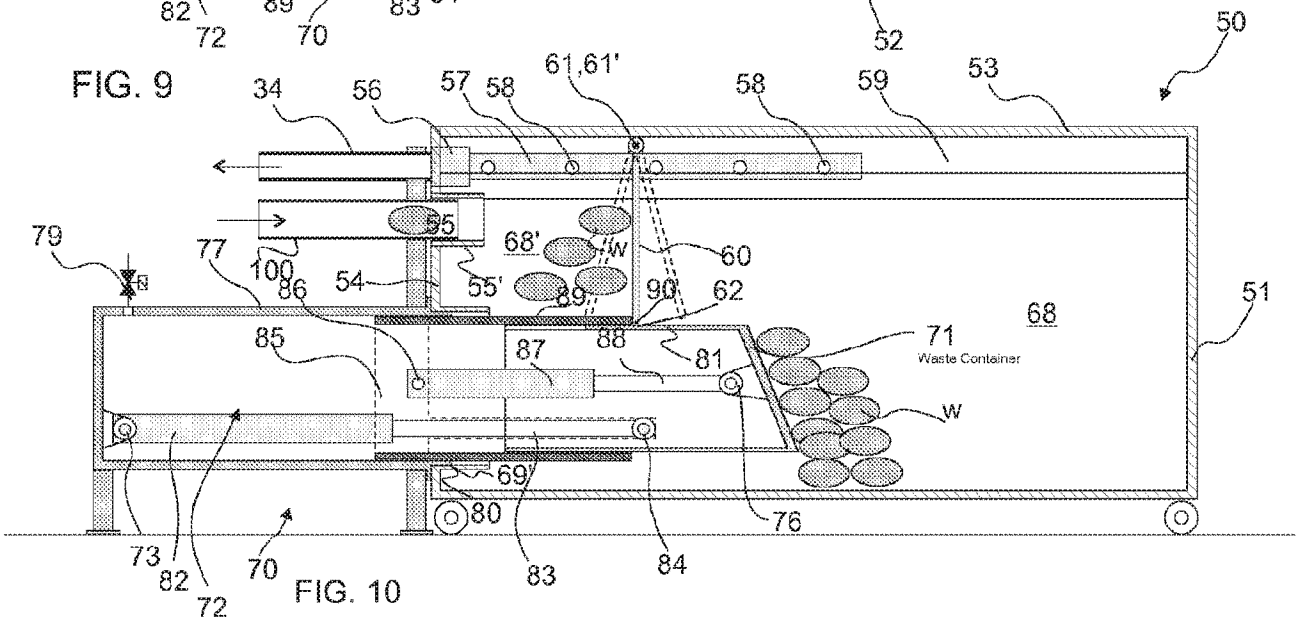
FIG. 10 presents a cross-section of the second embodiment of the apparatus according to the invention, in a second position.

FIGS. 9 and 10 present a second embodiment of the apparatus according to the invention, in which a movable part 89 is arranged in connection with the press device/compactor device 70, which movable part when extended settles in the proximity of the bottom part 62 of the wall 60 arranged in the container space 68 of the waste container/separating device 50 and if necessary supports the wall 60 preventing its essential movement, such as a rotary movement around the axis 61', towards the wall 54 on the side of the inlet aperture 55. The movable part 89 has a support surface 90, against which the bottom part 62 of the wall 60 can be supported. In the embodiment of FIGS. 9 and 10 the drive apparatus 72 of the press device/compactor device 70 comprises a two-phase arrangement, in which a first drive device 82, 83 is arranged to move the movable part 89 as well as a second drive device 87, 88 and the compressor 71 connected to it into a second position, and from which second position the compressor is moved with the second drive device 87, 88 into a third position, which is presented in FIG. 10. The first drive device 82, 83 is arranged at its first end 73, in FIG. 10 from the side of the cylinder 82, on the structures of the frame 77. At its second end 84, in FIG. 10 on the side of the rod 83 of the piston, the first drive device 82, 83 is arranged in a coupling part 85, into which the movable part 89 is arranged or which is a part of the movable part 89. The first end 86, in FIG. 10 the cylinder part 87, of the second drive device 87, 88 is in turn connected to the coupling part 85. The second end 76, in FIG. 10 on the side of the rod 88 of the piston, of the second drive device 87, 88 is connected to the compressor 71. In the embodiment of FIGS. 9 and 10 a longer compression stroke and more effective compacting in the container space 68 are achieved. In addition, the support surface 90 of the movable part 89 effectively prevents the undesired movement of the wall 60 towards the inlet aperture 55, and thus also for its part enhances the compaction of wastes in the container space 68.

In the embodiment of FIGS. 9 and 10 the movable part 89 is tubular and also functions as a bottom wall for the separating space 68' when the movable part 89 is in the second position, i.e. extended into the container 68.

Figure 11:
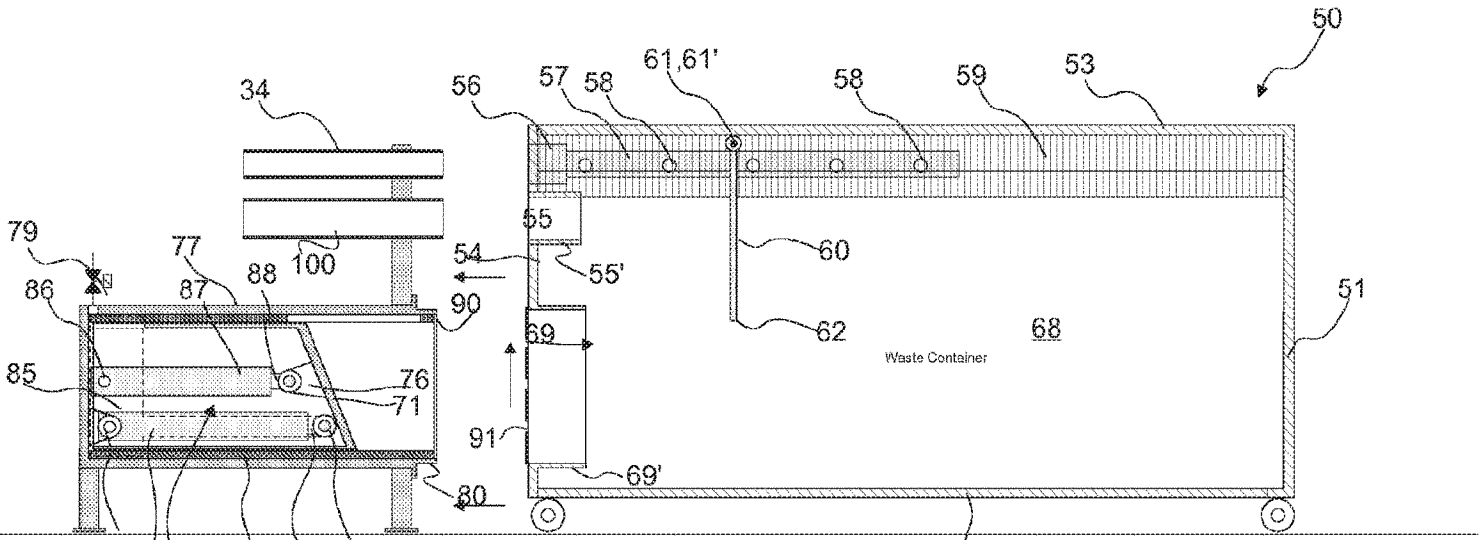
FIG. 11 presents a third embodiment of the apparatus according to the invention, in a first operating state.
Figure 12:
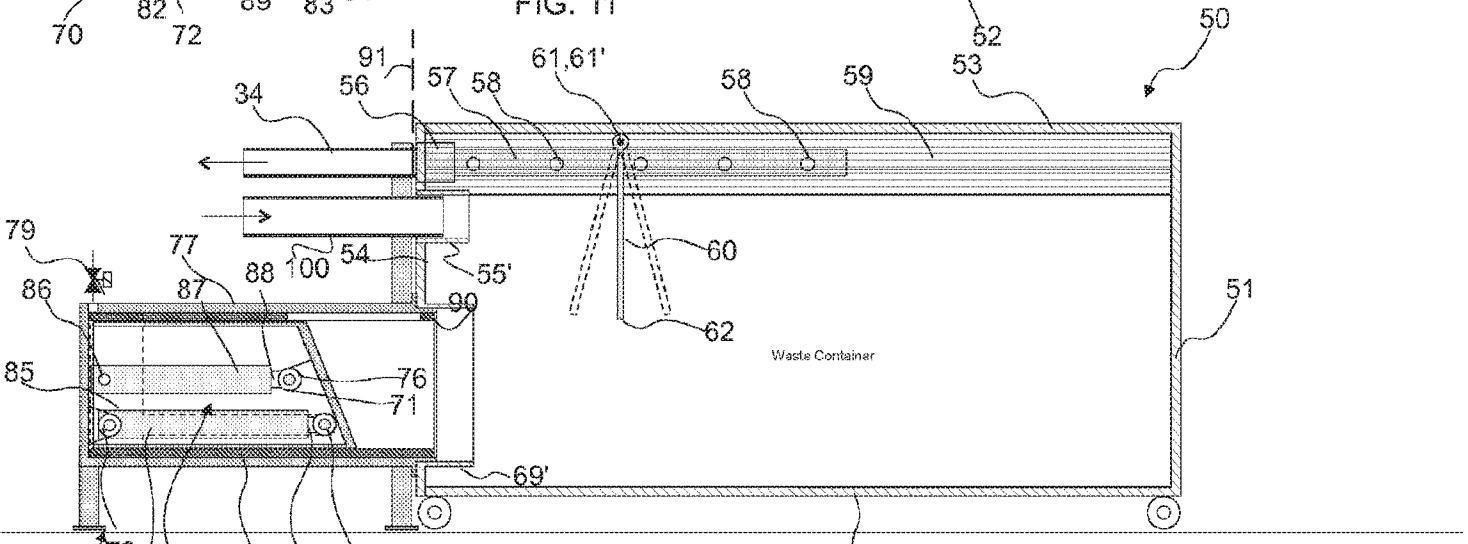
FIG. 12 presents the third embodiment of the apparatus according to the invention, in a second operating state.

FIGS. 11-14 further present a third embodiment of the invention. Likewise, FIGS. 11-14 present the bringing of a waste container/separating device 50 and connection of it in connection with a press device/compactor device 70 as well as a conveying pipe 100 and a channel 34 of a partial-vacuum generator. In FIG. 11 the waste container/separating device 50 is moved towards the press/compactor. The joint part 80 of the press/compactor device 70 and the end 100 of the conveying pipe as well as the end of the suction channel 34 are arranged in a supported manner in such a way that the necessary joints form, or are formed, when the waste container/separating device 50, the counterparts on it, the press aperture 69, inlet aperture 55 and connection 56 are brought against the joint part 80 and the end 100 of the conveying pipe and the end of the suction channel 34. According to one embodiment the hatch 91 is arranged to cover the aperture 69, which hatch is displaced from the position of FIG. 11 upwards into the position of FIG. 12, away from the front of the aperture 69 when the press device 70 is connected in connection with the waste container/separating device 50.

Figure 13:
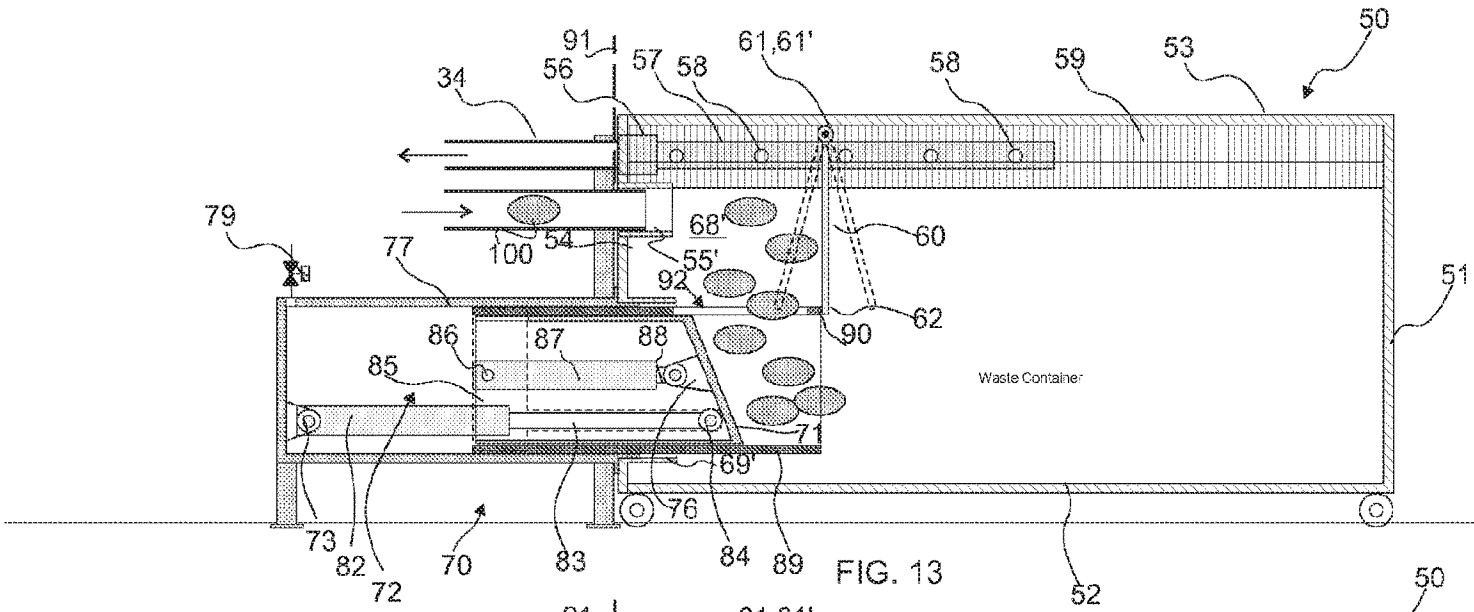
FIG. 13 presents the third embodiment of the apparatus according to the invention, in a third operating state.

In the embodiment of FIGS. 11-14 a movable part 89 functioning as a moving frame of the press is arranged in connection with the press device/compactor device 70, which movable part when extended settles in the proximity of the bottom part 62 of the wall 60 arranged in the container space 68 of the waste container/separating device 50 and if necessary supports the wall 60 preventing its essential movement, such as a rotary movement around the axis 61', towards the wall 54 on the side of the inlet aperture 55. The movable part 89 has a support surface 90, against which the bottom part 62 of the wall 60 can be supported. The movable part 89 has an aperture 92, which opens in the container space on the side of the inlet aperture 55 when the movable part 89 is taken into the second position (FIG. 13). From the aperture 92 material can pass to in front of the compressor 71 when the compressor is in the position according to FIG. 13. The actual compression movement and compacting are performed according to FIGS. 13 and 14.

In the embodiment of FIGS. 11-14 the drive apparatus 72 of the press device/compactor device 70 comprises a two-phase arrangement, in which a first drive device 82, 83 is arranged to move the movable part 89, which is now the moving frame of the press, as well as a second drive device 87, 88 and the compressor 71 connected to it into a second position.

Figure 14:
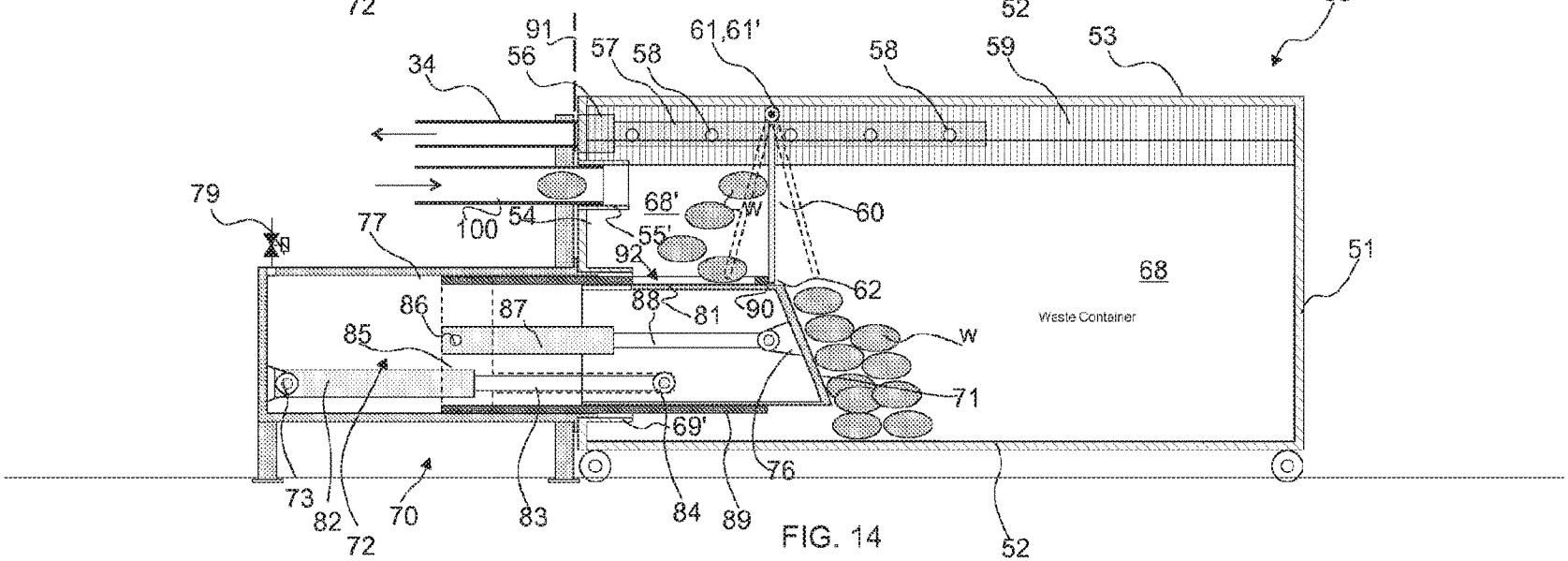
FIG. 14 presents the third embodiment of the apparatus according to the invention, in a fourth operating state.

From the second position the compressor 71 is moved with the second drive device 87, 88 into a third position, which is presented in FIG. 14.

The first drive device 82, 83 is arranged at its first end 73, in the figure on the side of the cylinder 82, on the structures of the frame 77. At its second end 84, in FIG. 14 on the side of the rod 83 of the piston, the first drive device 82, 83 is arranged in a coupling part 85, into which the movable part 89 is arranged or which is a part of the movable part 89. The first end 86, in FIG. 14 the cylinder part 87, of the second drive device 87, 88 is in turn connected to the coupling part 85. The second end 76, in FIG. 14 on the side of the rod 88 of the piston, of the second drive device 87, 88 is connected to the compressor 71.

In the embodiment of FIGS. 11-14 the material can be efficiently guided via the aperture 92 of the movable part 89 to in front of the compressor for conveying and compressing into the container space. In addition, a longer compression stroke and more effective compacting into the container space 68 are achieved. In addition, the support surface 90 of the movable part 89 effectively prevents the undesired movement of the wall 60 towards the inlet aperture 55, and thus also for its part enhances the compaction of wastes in the container space 68. The wall 81 of the compressor 71 prevents passage of the material via the aperture 92 when the compressor is in the position of FIG. 14, i.e. in the compression position.

FIGS. 15-22 present a fourth embodiment of the apparatus according to the invention, in which a movable part 89 is arranged in connection with the press device/compactor device 70, which movable part when extended settles in the proximity of the bottom part 62 of the wall 60 arranged in the container space 68 of the waste container/separating device 50 and if necessary supports the wall 60 preventing its essential movement, such as a rotary movement around the axis 61', towards the wall 54 on the side of the inlet aperture 55. The movable part 89 has a support surface 90, against which the bottom part 62 of the wall 60 can be supported. In the embodiment of the figures the drive apparatus 72 of the press device/compactor device 70 comprises a two-phase arrangement, in which a first drive device 82, 83 is arranged to move a movable part 89 as well as a second drive device 87, 88 and the compressor 71 connected to it into a second position, and from which second position the compressor is moved with the second drive device 87, 88 into a third position, which is presented in FIG. 21. The first drive device 82, 83 is arranged at its first end 73, in the figure on the side of the cylinder 82, on the structures of the frame 77. At its second end 84, in FIG. 21 on the side of the rod 83 of the piston, the first drive device 82, 83 is arranged in a coupling part 85, into which the movable part 89 is arranged or which is a part of the movable part 89. The first end 86, in FIG. 21 the cylinder part 87, of the second drive device 87, 88 is in turn connected to the coupling part 85. The second end 76, in FIG. 21 on the side of the rod 88 of the piston, of the second drive device 87, 88 is connected to the compressor 71. In the embodiment of FIGS. 15-22, a long compression stroke and an effective compacting in the container space 68 are achieved. In addition, the support surface 90 of the movable part 89 effectively prevents the undesired movement of the wall 60 towards the inlet aperture 55, and thus also for its part enhances the compaction of wastes in the container space 68.

In the embodiment of FIGS. 15-22 the movable part 89 is e.g. tubular and also functions as a bottom wall for the separating space 68' when the movable part 89 is in the third position, i.e. extended into the container 68.

Figure 15:
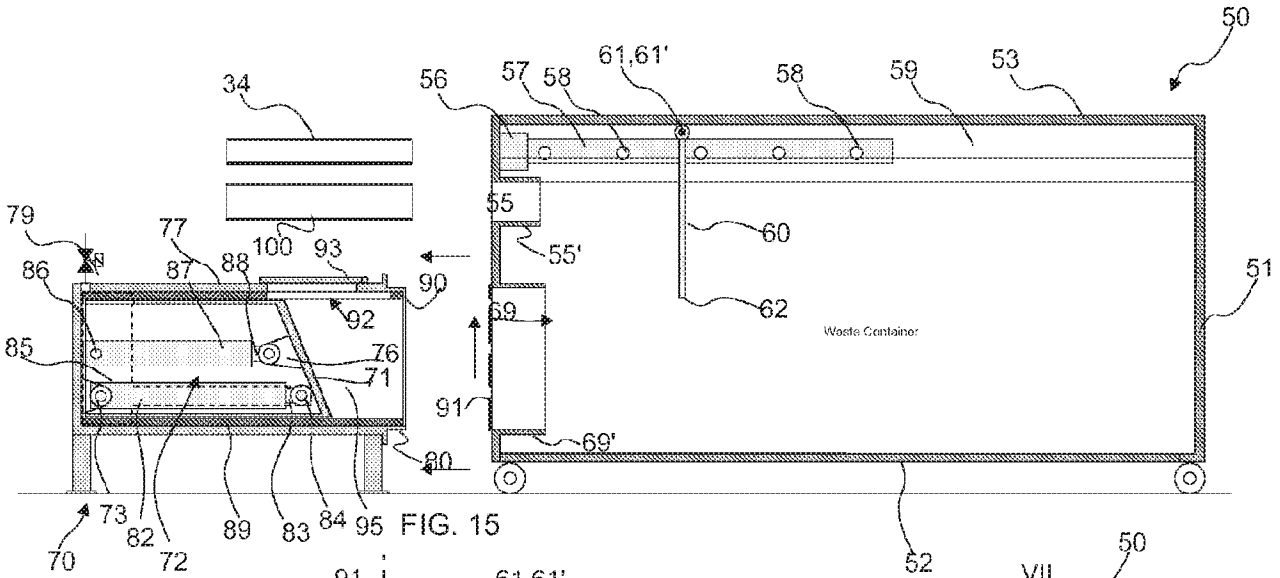
FIG. 15 presents a cross-section of a fourth embodiment of the apparatus according to the invention, in a first phase.
Figure 16:
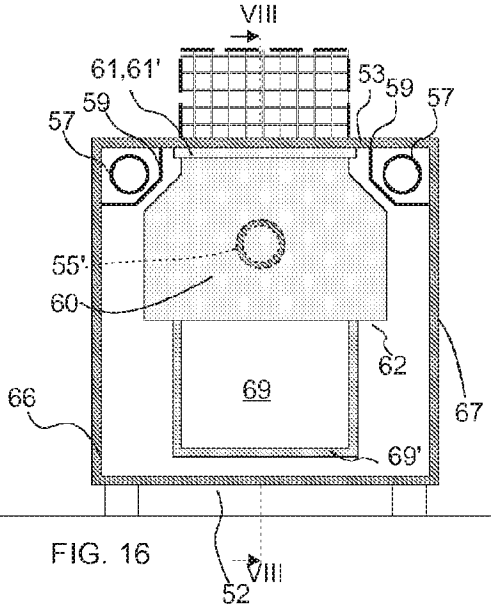
FIG. 16 presents the fourth embodiment of the apparatus according to the invention, cross-sectioned along the line VII-VII of FIG. 17.
Figure 17:
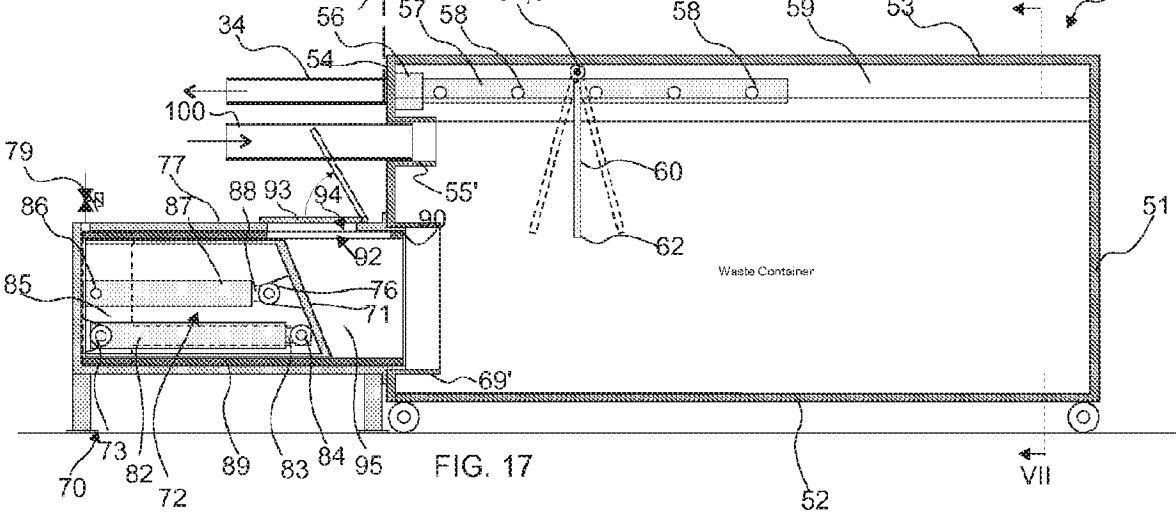
FIG. 17 presents the fourth embodiment of the apparatus according to the invention, in a second phase and cross-sectioned along the line VIII-VIII of FIG. 16.

FIG. 15 presents the bringing of a waste container/separating device 50 and connection of it in connection with a press device/compactor device 70 as well as a conveying pipe 100 and a channel 34 of a partial-vacuum generator. In FIG. 15 the waste container/separating device 50 is moved towards the press/compactor 70. The joint part 80 of the press/compactor device 70 and the end 100 of the conveying pipe as well as the end of the suction channel 34 are arranged in such a way that the necessary joints form, or are formed, when the waste container/separating device 50, the counterparts on it, the press aperture 69, inlet aperture 55 and connection 56 are brought against the joint part 80 and the end 100 of the conveying pipe and the end of the suction channel 34. According to one embodiment the hatch 91 is arranged to cover the aperture 69 of the waste container/separating device, which hatch is displaced from the position of FIG. 15 upwards into the position of FIG. 17, away from the front of the aperture 69, when the press device/compactor device 70 is connected in connection with the waste container/separating device 50.

Figure 18:
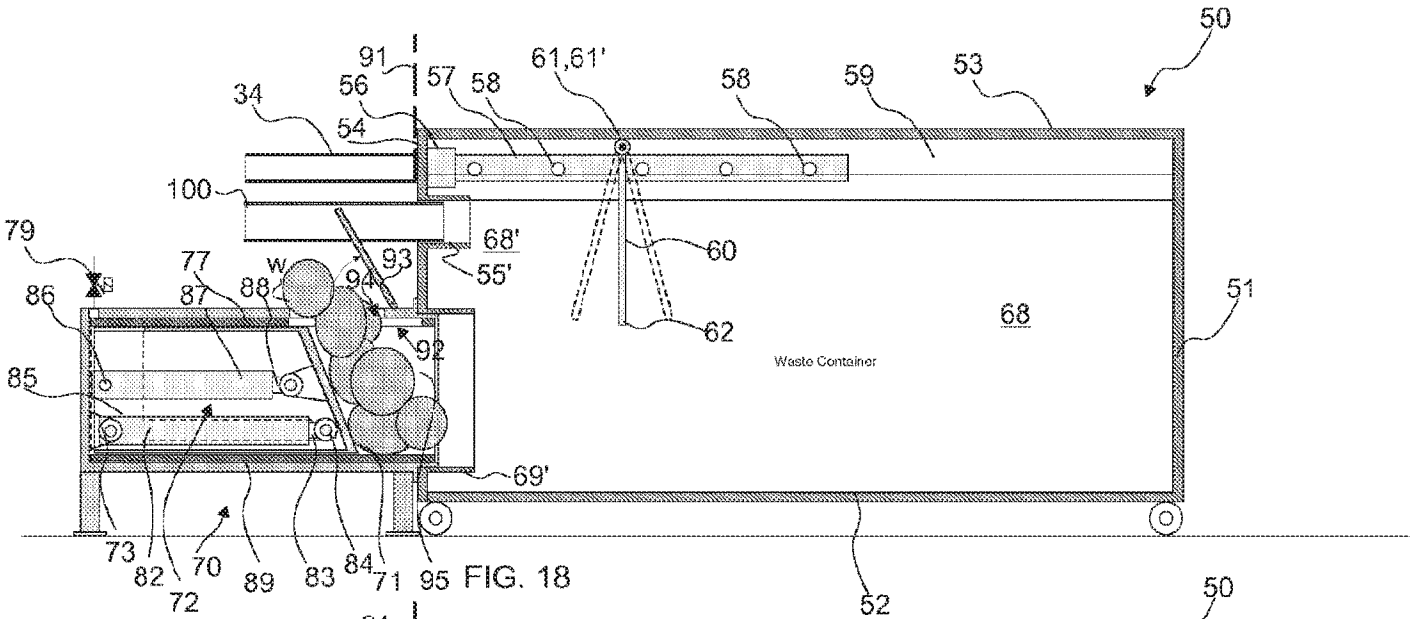
FIG. 18 presents a cross-section of the fourth embodiment of the apparatus according to the invention, in a second operating state, in the first phase of it.
Figure 19:
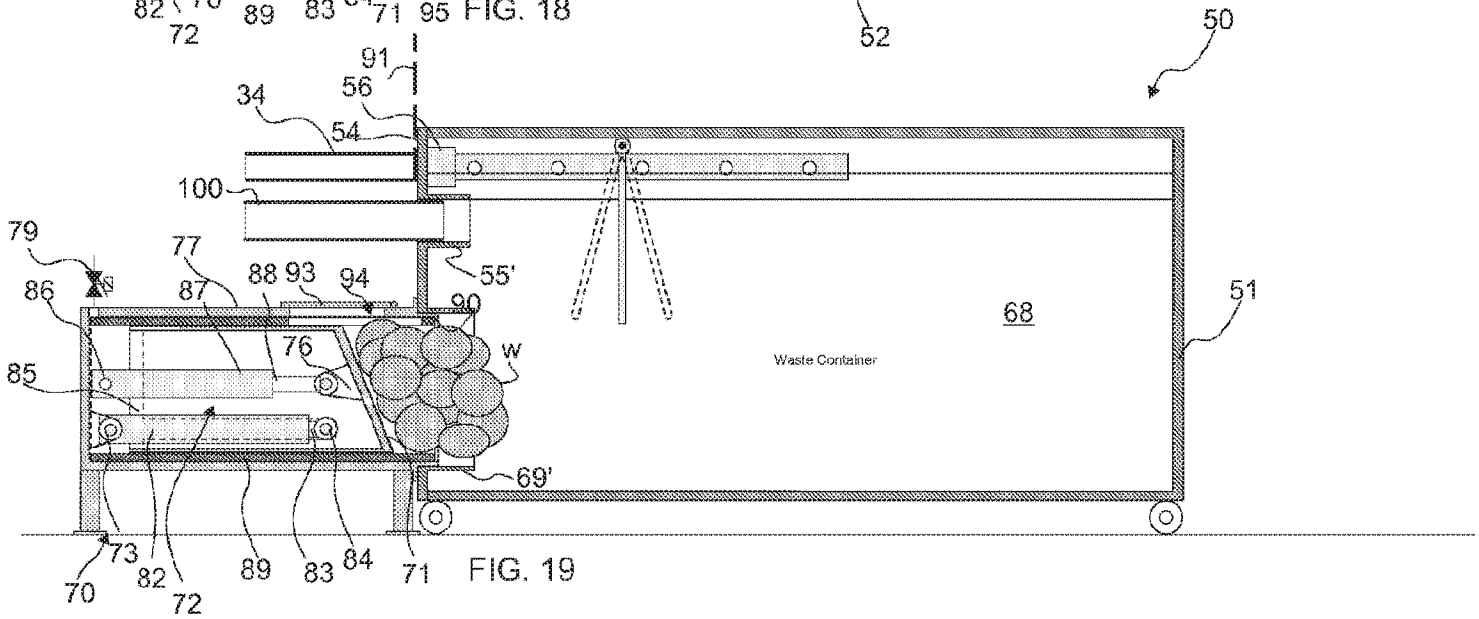
FIG. 19 presents a cross-section of the fourth embodiment of the apparatus according to the invention, in a second operating state, in the second phase of it.
Figure 20:
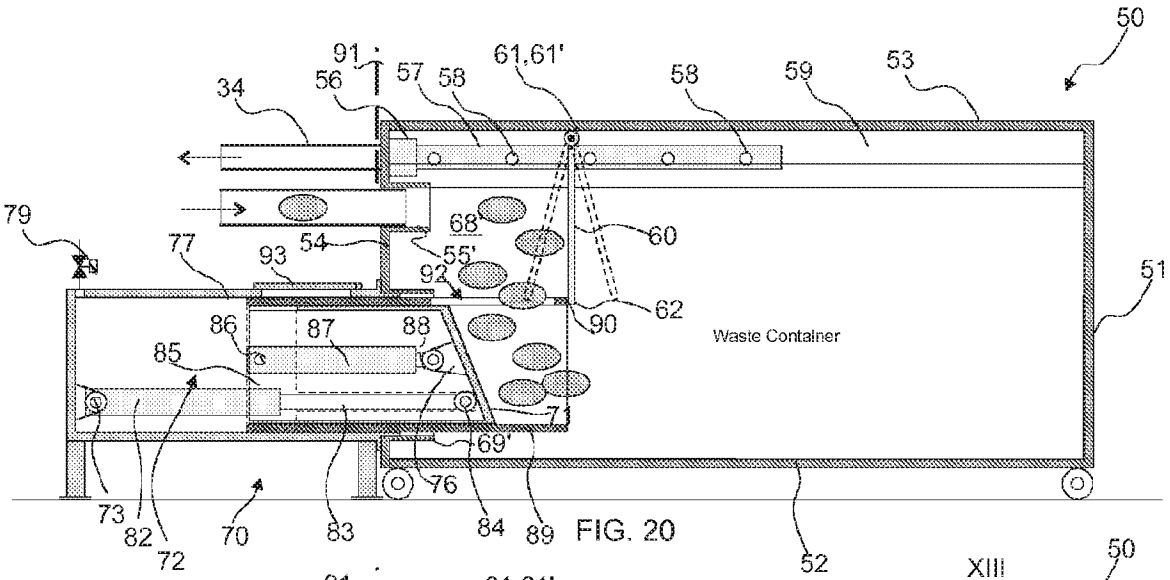
FIG. 20 presents the fourth embodiment of the apparatus according to the invention, in a third phase.

In the embodiment of FIGS. 15-22 a movable part 89 functioning as a moving frame of the press is arranged in connection with the press device/compactor device 70, which movable part when extended settles in the proximity of the bottom part 62 of the wall 60 arranged in the container space 68 of the waste container/separating device 50 and if necessary supports the wall 60 preventing its essential movement, such as a rotary movement around the axis 61', towards the wall 54 on the side of the inlet aperture 55. The movable part 89 has a support surface 90, against which the bottom part 62 of the wall 60 can be supported. The movable part 89 has an aperture 92, which opens in the container space on the side of the inlet aperture 55 when the movable part 89 is taken into the second position (FIG. 20). From the aperture 92 material can pass to in front of the compressor 71 when the compressor is in the position according to FIG. 20. The actual compression movement and compacting are performed according to FIGS. 21 and 22.

In the embodiment of FIGS. 15-22 the drive apparatus 72 of the press device/compactor device 70 comprises a two-phase arrangement, in which a first drive device 82, 83 is arranged to move the movable part 89, which is now the moving frame of the press, as well as a second drive device 87, 88 and the compressor 71 connected to it into a second position.

Figure 21:
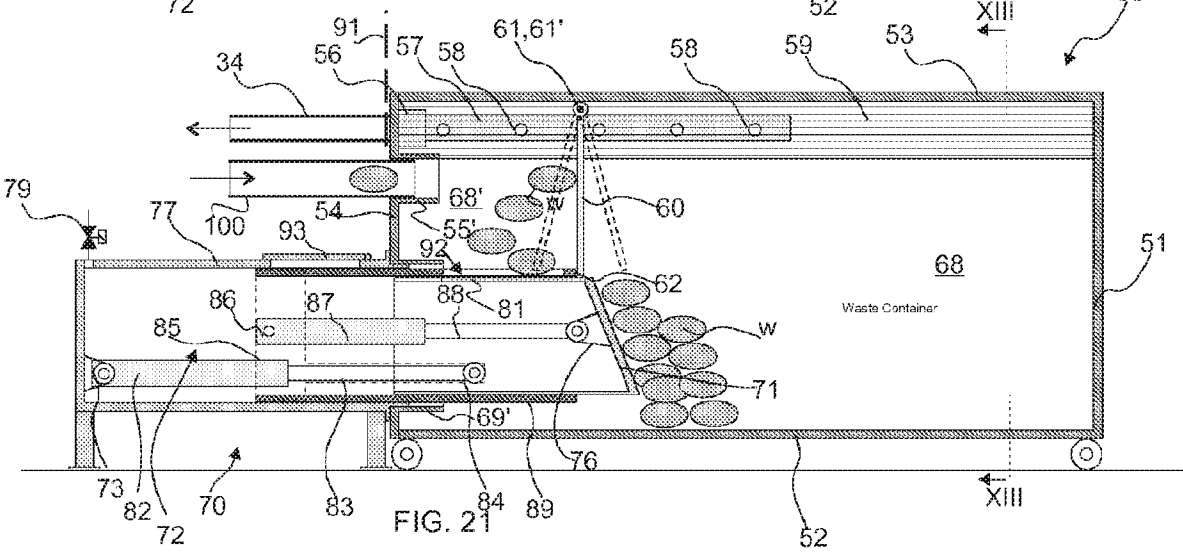
FIG. 21 presents the fourth embodiment of the apparatus according to the invention, in a fourth phase.
Figure 22:
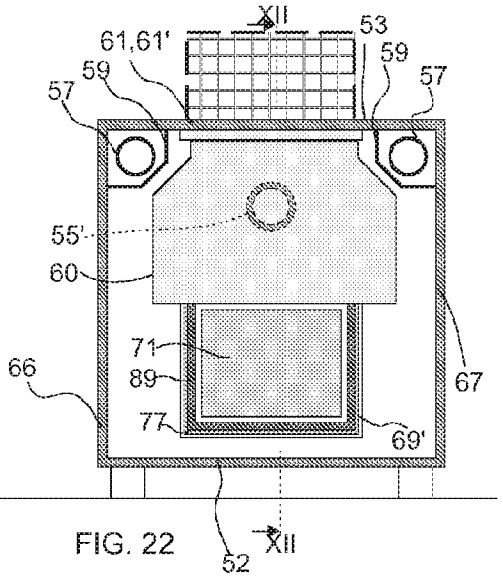
FIG. 22 presents the apparatus according to the invention, sectioned along the line XIII-XIII of FIG. 21.

From the second position the compressor 71 is moved with the second drive device 87, 88 into a third position, which is presented in FIG. 21.

The first drive device 82, 83 is arranged at its first end 73, in the figure on the side of the cylinder 82, on the structures of the frame 77. At its second end 84, in the figure on the side of the rod 83 of the piston, the first drive device 82, 83 is arranged in a coupling part 85, into which the movable part 89 is arranged or which is a part of the movable part 89. The first end 86, in the figure the cylinder part 87, of the second drive device 87, 88 is in turn connected to the coupling part 85. The second end 76, in the figure on the side of the rod 88 of the piston, of the second drive device 87, 88 is connected to the compressor 71.

In the embodiment of FIGS. 15-22 the material can be efficiently guided via the aperture 92 of the movable part 89 to in front of the compressor for conveying and compressing into the container space. In addition, a longer compression stroke and more effective compacting into the container space 68 are achieved. In addition, the support surface 90 of the movable part 89 effectively prevents the undesired movement of the wall 60 towards the inlet aperture 55, and thus also for its part enhances the compaction of wastes in the container space 68. The wall 88 of the compressor 71 prevents passage of the material via the aperture 92 when the compressor is in the position according to FIG. 21, i.e. in the compression position.

FIGS. 18 and 19 present an embodiment wherein an inlet aperture 94 is arranged in the press device/compactor device 70, in the top part of it, from which aperture material can be fed in, more particularly fed past, into the operating range of the compressor 71 of the press. The material can thus be fed in via the inlet aperture 94 of the press and the channel 95 and the aperture 69 of the container for compression in the container space 68. In this case e.g. the materials W which are not, owing to their size or other properties, suited for conveying in the conveying pipe 100 of the pneumatic pipe transport system for material, can be fed into the container space 68 of the waste container/separating device via the inlet aperture 94 of the press/compactor device, via the channel 95 and onwards via the aperture 69. An openable and closable hatch 93 is arranged in the embodiments of the figures to cover the inlet aperture 94 of the press. The hatch 93 is presented in simplified and diagrammatic manner. The shape and opening direction and other properties of it can be arranged according to each application site. The inlet aperture 94 is arranged face-to-face with the aperture 92 in the moving part, when the moving part is in the first position (FIG. 18).

In the situation of FIG. 18 the waste material W is fed in via the inlet aperture 94 of the press 70. In this case the suction being used in the conveying of the pneumatic material conveying system is switched off or kept at low negative pressure, which does not hinder opening of the hatch 93 or the feeding in of material via the inlet aperture 94 of the press. The compressor 71 is in the first position, in which case material is displaced by means of gravity via the inlet aperture 94 and the aperture 92 of the moving part 89 into the channel 95, from where there is a connection via the aperture 69 of the container into the container space 68. The material is displaced with the compressor 71 in the operating range in the channel of the compressor towards the container space and via the aperture 69 into the container space. This phase is presented in FIG. 10. With the drive devices of the compressor, most suitably with the second drive devices 87, 88, the compressor 71 and the material W pushed in the channel 95 by the compressor is displaced towards the container space and via the aperture 69 into the container space 68.

In FIGS. 18 and 19, the material W is described as simplified pieces. The material can be, for example, material, waste, recyclable material or other material packed into bags.

In the embodiment according to FIGS. 18 and 19 it is sufficient for only the second drive devices to displace the compressor. In this case the compressor 71 is moved to and fro in the operating range of the compressor while the moving part remains stationary. When it is desired to displace the material farther in the container space the first drive devices can also be used to displace the moving part and the second drive device and compressor along with it towards the situation of FIG. 20 and the compressor onwards with the second drive device into the situation of FIG. 21.

The invention thus relates to an apparatus for processing material in connection with a pneumatic material conveying system, which apparatus comprises a waste container/separating device 50, into which material is configured to be conducted from a conveying pipe 100 of the pneumatic material conveying system via the inlet aperture 55 and which is configured to be connected to means for achieving a partial vacuum. The apparatus further comprises a press device/compactor device 70, which is arranged to act on the material w conducted into the waste container/separating device 50, via at least one aperture 69 formed in the container, and that at least one wall 60 that is transverse with respect to the input direction of the material is arranged in the container space 68 of the waste container/separating device 50, which wall 60 is configured to guide the material into the operating range in the container space 68 of the compressor 71 of the press device/compactor device.

According to one embodiment the compressor 71 of the press device/compactor device is arranged to move in the container space with a drive apparatus 72 between a first position and a second position.

According to one embodiment the compressor 71 of the press device/compactor device 70 is arranged to move in the container space from the first position, in which the compressor 71 is not essentially in the container space 68, i.e. the compressor 71 is outside the container space 68, into a second position, in which the compressor extends to at least the point of the wall 60 in the container space 68.

According to one embodiment the apparatus comprises a movable part 89, which comprises a support surface 90, which is configured in the support position to support the wall 60.

According to one embodiment the wall 60 is arranged to be turnable or bendable at its top part 61 around the transverse axis 61'.

According to one embodiment the wall 60 is configured to receive the load exerted by the material w at least when it is supported with the support surface 90.

According to one embodiment an aperture 69 for the press device/compactor device 70 is formed in the wall 54 of the waste container/separating device 50 essentially in the proximity of the inlet aperture 55, most suitably below it.

According to one embodiment the press device/compactor device 70 comprises a movable part 89, which comprises a support surface 90 for the wall 60, which movable part is arranged to be moved with a drive apparatus 72.

According to one embodiment an aperture 92 is formed in the movable part 89, via which aperture the material is guided into the operating range of the compressor 71.

According to one embodiment the wall 60 is configured to limit the passage of material w from the container space 68 in the opposite direction with respect to the compression direction.

According to one embodiment the wall 60 is configured to limit the passage of material w from the container space 68 towards the container part 68', which comprises an inlet aperture 55, at least when the support surface 90 is arranged to support the wall 60.

According to one embodiment the press device/compactor device comprises a frame part 77, means for detachably connecting the frame part and the waste container/separating device 50 to each other, and also a compressor 71, which is arranged to be movable with drive means 72 into the frame part 77 between a first position, in which first position the compressor is outside the container space 68 of the waste container/separating device, and at least one second position, in which the compressor 71 extends into the container space 68 via the aperture 69 formed in the waste container/separating device. The frame part 77 and the waste container 50 are connected by the joint formed by the joint part 80 of the frame and the counterpart (collar 69') of the waste container. The joint part and the counterpart form the means for detachably connecting the frame part and the waste container.

According to one embodiment the compressor 71 of the press device/compactor device 70 is arranged to act on the material w conducted into the waste container/separating device 50, via at least one aperture 69 formed in the container, and that the press device/compactor device 70 also comprises an inlet aperture 94 for material, from which inlet aperture 94 the material fed in is configured to be displaced into the operating range of the compressor 71, which compressor 71 is arranged movably in such a way that the material W fed in from the inlet aperture 94 is configured to be displaced, moved by the compressor 71, via the aperture 69 formed in the wall of the waste container/separating device into the container space 68 of the waste container/separating device 50.

According to one embodiment the press device/compactor device 70 comprises a movable part 89, along with which the compressor 71 and at least a part of the moving means 86, 87, 88 of the compressor are arranged to be movable, which movable part 89 can be moved between at least one first position, in which the movable part is outside the waste container/separating device 50, and one second position, in which the movable part 89 extends via the aperture 69 into the container space 68 of the waste container/separating device 50. The drive means 72 is used to describe the structure of the drive apparatus 72 that may be a pressure-medium-driven cylinder piston combination 74, 75 for moving the compressor 71. As indicated above, the moving means is denoted by reference numerals 86, 87 and 88. The phrase "second drive device 87, 88" refers to the top hydraulic cylinder as illustrated in FIG. 9. The phrase "first end 86 of the cylinder part 87" refers to the end that is connected to the coupling part 85.

According to one embodiment the drive apparatus 72 of the press device/compactor device 70 comprises an arrangement, in which a first drive device 82, 83 is arranged to move the movable part 89 as well as a second drive device 87, 88 and the compressor 71 connected to it in relation to the frame 77, and the second drive device 87, 88, which is arranged to move the compressor 71 in relation to the movable part 89.

According to one embodiment the inlet aperture 94 of the press device/compactor device is configured in at least one operating position of the movable part face-to-face with the aperture 92 of the movable part.

The invention also relates to a waste container/separating device for pneumatic pipe transporting systems for material, which device comprises at least one inlet aperture for connecting it to a material conveying pipe, means for connecting a partial-vacuum generator to the container and means for connecting a press device/compactor device. At least one wall 60 that is transverse with respect to the input direction of the material is arranged in the container space 68 of the waste container/separating device, which wall is configured to guide the material into the operating range in the container space 68 of the compressor 71 of the press device/compactor device.

According to one embodiment the wall 60 extends to a part of the height of the container space 68.

According to one embodiment the wall 60 is arranged to be turnable or bendable at its top part 61 around the transverse axis 61'.

According to one embodiment the wall 60 is arranged at its top part 61 on the upper wall 53 of the waste container/separating device or in the proximity of said upper wall.

According to one embodiment the wall 60 is configured to be supported, preferably at its bottom part 62, on the support surface 90 of the press or on another support surface.

According to one embodiment the wall 60 is arranged to turn away from the front when the waste container/separating device 50 is emptied of material w.

According to one embodiment the wall 60 is configured to receive the load exerted by the material w at least when it is supported with the support surface 90.

According to one embodiment the waste container/separating device 50 comprises a suction pipe 57 arranged in the top part of the container space 68.

According to one embodiment the aperture 69 of the press arranged in the waste container/separating device 50 and the inlet aperture 55 are in the proximity of each other, preferably in the same wall 54.

According to one embodiment the wall 60 is configured to limit the passage of material w from the container space 68 in the opposite direction with respect to the compression direction.

According to one embodiment the wall 60 is configured to limit the passage of material w from the container space towards the inlet aperture 55, at least when the support surface 90 is arranged to support the wall.

According to one embodiment the waste container/separating device is container of the mobile freight container type.

The invention also relates to a press device/compactor device, which is configured to be connected to the waste container/separating device 50 of a pneumatic material conveying system. The press device/compactor device comprises a frame part 77, means for detachably connecting the frame part and the waste container/separating device 50 to each other, and also a compressor 71, which is arranged to be movable with drive means 72 into the frame part 77 between a first position, in which first position the compressor is outside the container space 68 of the waste container/separating device, and at least one second position, in which the compressor 71 extends into the container space 68 via the aperture 69 formed in the waste container/separating device.

According to one embodiment a pathway is arranged in the frame part 77, which pathway is configured face-to-face with the aperture 69 formed in the wall 54 of the waste container/separating device, from which aperture the compressor 71 is arranged to be moved into the container space 68 of the waste container/separating device.

According to one embodiment an inlet aperture 94 is arranged in the frame 77 of the press device/compactor device, from which aperture material is configured to be fed into the operating range of the compressor 71.

According to one embodiment the press device/compactor device 70 also comprises an inlet aperture 94 for material, from which inlet aperture 94 the material fed in is configured to be displaced into the operating range of the compressor 71, that the compressor 71 is arranged movably in such a way that the material W fed in from the inlet aperture 94 is configured to be displaced, moved by the compressor 71, via the aperture 69 formed in the wall 54 of the waste container/separating device 50 into the container space 68 of the waste container/separating device 50.

According to one embodiment the press device/compactor device 70 comprises a movable part 89, along with which the compressor 71 and at least a part of the moving means 86, 87, 88 of the compressor are arranged to be movable, which movable part 89 can be moved between at least one first position, in which the movable part is outside the waste container/separating device 50, and one second position, in which the movable part 89 extends via the aperture 69 into the container space 68 of the waste container/separating device 50.

According to one embodiment an aperture 92 is formed in the movable part 89, via which aperture the material is guided into the operating range of the compressor 71.

According to one embodiment the inlet aperture 94 of the press device/compactor device is configured in one operating position of the movable part face-to-face with the aperture 92 of the movable part.

According to one embodiment the drive apparatus 72 of the press device/compactor device 70 comprises an arrangement, in which a first drive device 82, 83 is arranged to move the movable part 89 as well as a second drive device 87, 88 and the compressor 71 connected to it in relation to the frame 77, and a second drive device 87, 88, which is arranged to move the compressor 71 in relation to the movable part 89.

According to one embodiment the press device/compactor device 70 comprises a movable part 89, comprising a support surface 90 for at least one wall 60 arranged transverse to the input direction of the material in the container space 68 of the waste container/separating device 50.

According to one embodiment the waste container/separating device is container of the mobile freight container type.

Typically the material is waste material, such as waste material arranged in bags. A refuse chute can be configured to be a part of a pneumatic waste conveying system or it can be a separate part, in which waste material is conducted into a waste room, waste container or corresponding.

Typically the material is waste material, such as waste material arranged in bags. A refuse chute can be configured to be a part of a pneumatic waste conveying system or it can be a separate part, in which waste material is conducted into a waste room, waste container or corresponding.

It is obvious to the person skilled in the art that the invention is not limited to the embodiments presented above, but that it can be varied within the scope of the claims presented below. The characteristic features possibly presented in the description in conjunction with other characteristic features can if necessary be used separately to each other.

The invention claimed is:

1. A press device/compactor device, which is configured to be connected to a waste container/separating device of a pneumatic material conveying system, comprising:

a frame part configured to be detachably connected to the waste container/separating device;

a compressor which is movable by a drive into the frame part between a first position, in which first position the compressor is outside a container space of the waste container/separating device, and at least one second position, in which the compressor extends into the container space via an aperture formed in the waste container/separating device; and a support surface for at least one wall arranged transverse to an input direction of the material in the container space of the waste container/separating device, the at least one wall arranged to be turnable or bendable at its top part around a transverse axis.

2. The press device/compactor device according to claim 1, wherein a pathway is arranged in the frame part, the pathway configured to be face-to-face with an aperture formed in the waste container/separating device, from which aperture the compressor is arranged to be movable into the container space of the waste container/separating device.

3. The press device/compactor device according to claim 1, wherein an inlet aperture is arranged in the frame part of the press device/compactor device, from which inlet aperture material is configured to be fed into an operating range of the compressor.

4. The press device/compactor device according to claim 1, further comprising an inlet aperture for material, from which inlet aperture the material fed in is configured to be displaced into an operating range of the compressor, wherein the compressor is arranged movably in such a way that the material (W) fed in from the inlet aperture is configured to be displaced, moved by the compressor, via an aperture formed in the waste container/separating device into the container space of the waste container/separating device.

5. The press device/compactor device according to claim 1, further comprising a movable part, along with which the compressor and at least a part of the drive of the compressor are arranged to be movable, which movable part can be moved between at least one first position, in which the movable part is inside the frame part, and a second position, in which the movable part extends outside the frame part.

6. The press device/compactor device according to claim 5, wherein an aperture is formed in the movable part, via which aperture the material is guided into an operating range of the compressor.

7. The press device/compactor device according to claim 6, further comprising an inlet aperture in the frame part of the press device/compactor device, the inlet aperture configured to be aligned with the aperture of the movable part in one operating position of the movable part.

8. The press device/compactor device according to claim 1, wherein the drive of the press device/compactor device comprises a first drive arranged to move a movable part relative to the frame part and a second drive device moving the compressor relative to the movable part.

9. The press device/compactor device according to claim 1, wherein the press device/compactor device comprises a movable part, comprising the support surface for the at least one wall arranged transverse to the input direction of the material in the container space of the waste container/separating device.

10. The press device/compactor device according to claim 1, wherein the frame part has an open end and a rear wall opposite the open end.

11. The press device/compactor device according to claim 6, wherein the aperture is in a top wall of the movable part.

12. A press device/compactor device, which is configured to be connected to a waste container/separating device of a pneumatic material conveying system, comprising:

a frame part configured to be detachably connected to the waste container/separating device, the frame part having an open end;

a compressor which is movable in a first direction by a drive into the frame part between a first position, in which the compressor is inside the frame part, and at least one second position, in which the compressor extends outside the frame part; and a support surface movable relative to the compressor in the first direction, the support surface having a first position in which the support surface is inside the frame part, and a second position, in which the support surface extends outside the frame part.

13. The press device/compactor device according to claim 12, wherein the support surface moves in the first direction further from the frame part than the compressor.

14. The press device/compactor device according to claim 12, wherein the support surface is linearly movable relative to the compressor.

* * * * *